United States Patent [19]

Kimura et al.

[11] Patent Number: 4,666,801

[45] Date of Patent: May 19, 1987

[54] METHOD AND APPARATUS FOR FORMING A TONER IMAGE IN ELECTROPHOTOGRAPHIC PRINTING

[75] Inventors: Masatoshi Kimura; Junzo Nakajima, both of Yokohama, Japan

[73] Assignee: Fujitsu Limited, Kanagawa, Japan

[21] Appl. No.: 762,431

[22] Filed: Aug. 5, 1985

[30] Foreign Application Priority Data

Aug. 10, 1984 [JP] Japan ..... 59-168208
Aug. 20, 1984 [JP] Japan ..... 59-173636

[51] Int. Cl.[4] ..... G03G 13/24

[52] U.S. Cl. ..... 430/33; 430/120; 118/653

[58] Field of Search ..... 430/31, 120, 55, 33; 118/653

[56] References Cited

U.S. PATENT DOCUMENTS

| | | | |
|---|---|---|---|
| 3,203,394 | 8/1965 | Hope et al. | 430/120 |
| 4,063,945 | 12/1977 | Von Hoene | 430/55 |
| 4,197,119 | 4/1980 | Sadamatsu | 430/55 |
| 4,311,778 | 1/1982 | Kadowaki | 430/54 |
| 4,336,317 | 6/1982 | Ando | 430/120 |

FOREIGN PATENT DOCUMENTS 2338837 2/1974 Fed. Rep. of Germany .

*Primary Examiner*—John L. Goodrow
*Attorney, Agent, or Firm*—Staas & Halsey

[57] ABSTRACT

An electrophotographic printing apparatus employs a laminated, photosensitive medium including transparent supporting and conducting layers and a photosensitive layer defining the top surface of the medium, on which a toner image is formed. A first developer, maintained at a voltage of the same polarity as the toner particles, forms a uniform layer of charged toner particles on the surface of the photoconductive layer, the charged particles adhering to the surface. Simultaneously or subsequently, an optical beam is projected onto the photoconductive layer in accordance with the image to be printed, rendering the selectively exposed portions sufficiently conductive to permit charges of opposite polarity to be injected into the photoconductive layer from the conducting layer; the photoconductive layer establishes trapping potential levels therein, permitting the charges to traverse the layer to positions adjacent the top surface thereof. Upon extinguishing the optical beam, the photoconductive layer reverts to a nonconductive state, fixing the trapped charges in position as a laten electrostatic image. The latent electrostatic image establishes a field, or Coulomb force, which closely adheres the oppositely charged toner particles to the surface. In a second developing step, a developer, to which is applied a voltage of opposite polarity relative to that of the toner particles, then removes the toner particles from the nonexposed portions of the surface; the toner particles on the exposed portions of the surface are more firmly adhered thereto by virtue of the latent electrostatic image and thus a substantial portion thereof remain, providing a high contrast toner particle image for subsequent transfer to a suitable recording medium.

29 Claims, 16 Drawing Figures

METHOD AND APPARATUS FOR FORMING A TONER IMAGE IN ELECTROPHOTOGRAPHIC PRINTING

BACKGROUND OF THE INVENTION

Field of the Invention

This invention relates to an electrophotographic printing method and related apparatus for forming a toner image on a photosensitive medium. More particularly, it relates to a reversal imaging method and related apparatus for fixing toner particles on a portion of a photosensitive medium which is exposed to a light beam selectively projected thereon in accordance with an image of an object, to form a toner image of the object for subsequent printing on a suitable recording medium (e.g., paper).

There have been developed various electrophotographic printers in which a latent electrostatic image is formed by projecting an optical beam onto a photoconductive layer of a photosensitive medium. The resultant latent electrostatic image is thereafter developed into a toner image by depositing toner particles on the photoconductive layer. The toner image thereafter is transferred onto a recording paper and fixed thereon.

The principle of one such prior art method is illustrated in FIGS. 1(*a*) to 1(*c*), to which the following description is directed. A photosensitive medium 1 comprises an electrode 7 and a photoconductive layer 8, such as a selenium layer which may be evaporated on the electrode 7. Initially, the medium 1 is charged uniformly by a corona discharging device 2, as shown in FIG. 1(*a*), to produce a uniform layer of ions, illustrated as positive ions in the example of FIG. 1(*a*). Subsequently, an optical beam, such as a laser beam, is projected in the direction designated by the arrow L onto the surface of the photoconductive layer 8, for selectively exposing same and rendering the exposed portions conductive, thereby selectively discharging the positive ions thereon to ground. The optical beam is scanned over the photoconductive layer 8 and its optical density is controlled, in accordance with an image to be printed. The latent electrostatic image thus formed then is developed to form a toner image, by using a magnetic brush developer 4 as illustrated in FIG. 1(*c*). For this purpose, the electrode 7 is grounded and a positive voltage is applied to the developer 4, wherein fine particles referred to as toner particles 6 are mixed with relatively coarse iron particles, referred to as carriers 5. The toner particles 6 are charged triboelectrically, and adhere to the surface of the photosensitive medium 1 in a pattern corresponding to the latent electrostatic image, as shown in FIG. 1(*c*). The visual toner image, thus produced on the photosensitive medium 1, subsequently is transferred to and fixed on a suitable recording paper (not shown).

The use of a corona discharging device for charging the photosensitive medium layer in such prior art electrophotographic printing systems, as described above, presents many problems. For example, to generate the corona discharge, a high voltage source must be provided, typically of several thousand volts (KV). Moreover, the corona discharge is very sensitive to atmospheric conditions, such as the level of humidity and the presence of dust and other contaminants in the air. Additionally, the corona discharge generates ozone, recognized to constitute a health hazard to operators. Thus, corona discharging devices are not only expensive, but present problems of unstable printing operations as well as health hazards to operators. Accordingly, there has been a need in the art to develop electrophotographic printing techniques which eliminate the use of corona discharging devices.

One example of an electrophotographic method which eliminates the use of corona discharging devices is disclosed in Japanese patent application by Ishihara et al., laid open under Provisional Publication No. 119375/82 on July 24, 1982. FIG. 2 is a schematic cross-sectional view of equipment operating in accordance with that method, and serves to illustrate the principle of the method. A photosensitive medium 15 comprises a laminant of a transparent supporting layer 11, a transparent electrode 12 made of ITO (Indium-Tin-Oxide), a photoconductive layer 13 made of Cds (cadmium sulfide), and an insulating layer 14, as an example.

Power source 18 applies a voltage between the transparent electrode 12 and a developer device 17, which may comprise a conventional magnetic brush developer. The developer 17 applies a uniform layer of magnetic toner particles 16 onto the surface of the insulating layer 14. A light represented by the arrow L then is projected onto the bottom surface of the supporting layer 11, for selectively exposing the photoconductive layer 13 in accordance with an image to be produced and rendering those exposed portions of the photoconductive layer 14 conductive. As a result, negative charges 20 are injected into the exposed portions of the photoconductive layer 13 and travel therethrough to the boundary or interface between the photoconductive layer 13 and the insulating layer 14. Positive charges injected into the conductive toner particles 16, meanwhile, are developed at the surface of the insulating layer 14, as illustrated by the positive charges 19 in the toner particles 16 at the surface of the insulating layer 14. The positive charges 19 and negative charges 20 generate a relatively strong electric field across the insulating layer 14. As a result, the particles 16 having the positive charges 19 adhere strongly to the surface of the medium 15, and thus of the insulating layer 14, in those portions thereof which correspond to the exposed areas of the photoconductive layer 13, after extinguishing the scanning light beam L.

Conversely, at those portions of the upper surface of the photosensitive medium 15 which have not been exposed, there is no such strong adhering effect between the toner particles 16 and the insulating layer 14, because the photoconductive layer 13 remains nonconductive in those nonexposed portions and, moreover, because it has a substantial thickness. Accordingly, the toner particles 16 in these nonexposed areas do not adhere strongly to the surface of the insulating layer 14 and accordingly are collected and removed by the developer 17. The retained, adhered particles 16 thus form the toner image.

While the electrophotographic printing method as described in relation to FIG. 2 thus avoids the defects and problems of employing high voltage corona discharging devices, it introduces other problems. For example, the photoconductive layer 13 must be relatively thick to achieve a satisfactory contrast in the toner image, since the formation of the toner image is achieved by utilizing the difference in the adhering force, known as a Coulomb force, generated by each of the respective electric fields, as between the exposed and unexposed regions. The fabrication of such a thick photoconductive layer of uniform thickness is both difficult and expensive, in view of the material costs. Moreover, while increasing the thickness of the photoconductive layer is important to achieve improved contrast, increasing the thickness reduces the photosensitivity of the layer with the resultant requirement of increasing the recording voltage. Moreover, since conductive toner particles are employed in this method, plain paper, in view of its relatively low resistivity, is not suitable as the recording medium to which the toner image is transferred and instead a specially treated medium, for example, a paper coated with an insulating layer, must be used.

As a result, there remains a need in the art for improved techniques of electrophotographic printing which avoid the foregoing and further problems and deficiencies of prior art techniques.

SUMMARY OF THE INVENTION

Accordingly, it is an object of the present invention to provide a method and apparatus for forming a toner image by electrophotographic printing, which eliminates the use of a corona discharging device, and which is more compact and more reliable, yet less costly, than heretofore available in the prior art.

Another object of the present invention is to provide a an electrophotographic printing method and apparatus which forms a toner image having improved contrast, including reduced background toner density, relative to such toner images produced by prior art apparatus and methods.

These and other objects of the invention are achieved in accordance with the arrangement of the apparatus and the practice of the method in accordance with the invention, as implemented in each of various different embodiments which are hereinafter disclosed. In general, the invention employs a photosensitive medium comprising laminated layers including a transparent supporting layer on which is disposed a transparent conductive layer, the latter functioning as a transparent electrode, and a photoconductive layer, the top surface of the latter defining, as well, the surface of the medium on which a toner image is to be formed. The photoconductive layer is formed of an organic photoconductive material which normally is insulating and thus nonconductive, but which is converted by exposure to a scanning light beam to a state in which it is almost, but not completely, conductive. In the conductive state, charges can traverse, i.e., travel through, the thickness of the photoconductive layer from the surface common with the underlying conductive layer to positions closely adjacent the top surface of the photoconductive layer (i.e., that top surface defining the surface of the photosensitive medium on which the toner image is to be formed). The photoconductive layer has several trapping potential levels therein, which electrically trap the charges adjacent the top surface of the photoconductive layer. Following the selective exposure of portions of the photoconductive layer, and either upon extinguishing the scanning light beam or as the light beam advances to scan different portions, the photoconductive layer reverts to its normal insulating, or nonconducting, state, fixing the charges therein at the positions established by the trapping potential levels during the prior exposure step.

In practicing the method of the invention through use of the apparatus as disclosed herein, in a first developer station, or step, the top surface of the photoconductive layer is covered with a uniform layer of previously charged toner particles by a first developer, which may comprise a conventional magnetic brush developer. In the exposure step, a light beam, such as a laser beam, is projected onto the photosensitive medium through the transparent supporting and conducting layers, the beam being controlled to scan an image pattern of an object to be printed, rendering the scanned, or exposed, portions conductive. In this exposure step, charges of opposite polarity, previously induced in the conducting layer as a result of the layer of charged toner particles, advance through the exposed, conductive portions of the photoconductive layer to positions adjacent the top surface thereof, the charges being trapped electrically therein by the aforedescribed trapping potential levels. The charges thus form a latent electrostatic image, which becomes fixed in position when the scanning beam is extinguished and the photoconductive layer reverts to its insulating state. The first developing step and the exposure step may be performed in succession or simultaneously, in accordance with different embodiments of the invention as herein disclosed. The second developer station employes a second developer device, which likewise may comprise a conventional magnetic brush developer; in the corresponding, second developing step performed thereby, toner particles disposed on the surface of the nonexposed portions of the photoconductive layer are removed, while those particles on the surface of the exposed portions are retained, since tightly adhered to the surface of the photoconductive layer by the corresponding electrostatic latent image. Thus, the toner image is produced in two successive developing steps, in conjunction with the exposure step which is performed either simultaneously with the first developing step or sequentially thereafter, intermediate the two developing steps. The retained toner image then is transferred to a suitable recording paper which, significantly, may be plain paper in at least certain embodiments of the invention.

The electrophotographic apparatus and method of the invention offers the significant advantage of employing relatively low developing voltages. Voltages as low as 100 V may be used in those applications employing the conductive toner particles, when use of an insulative recording paper is acceptable. On the other hand, a developing voltage in the range of 500 V is sufficient when employing nonconductive toner particles, to gain the advantage of using plain recording paper.

Accordingly, the method and apparatus of the invention achieves the significant results of eliminating the use of corona discharging devices, permits use of relatively low operating voltages, and may accomodate the use of either conductive or nonconductive toner particles. The images developed are of high quality and high contrast with reduced background optical density, relative to prior art techniques. These and other advantages of the invention will become more apparent from the following detailed description of the embodiments of the invention, with reference to the accompanying drawings.

DESCRIPTION OF THE PREFERRED EMBODIMENTS

Figure 1A:
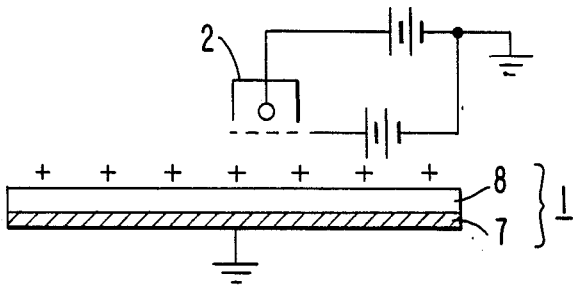
FIG. 1(a) (PRIOR ART)
FIGS. 1(*a*) to 1(*c*) comprise a succession of schematic, elevational views representing sequential processing steps in forming a toner image in accordance with a prior art electrophotographic printing method employing a corona discharging device.
Figure 1B:
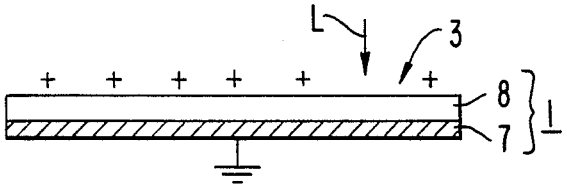
FIG. 1(b) (PRIOR ART)
Figure 1C:
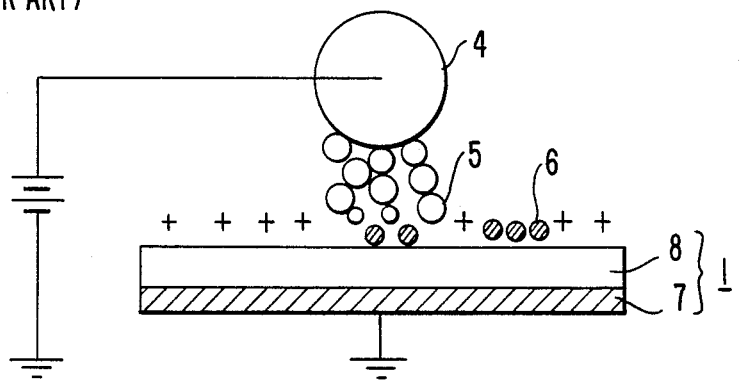
FIG. 1(c) (PRIOR ART)
Figure 2:
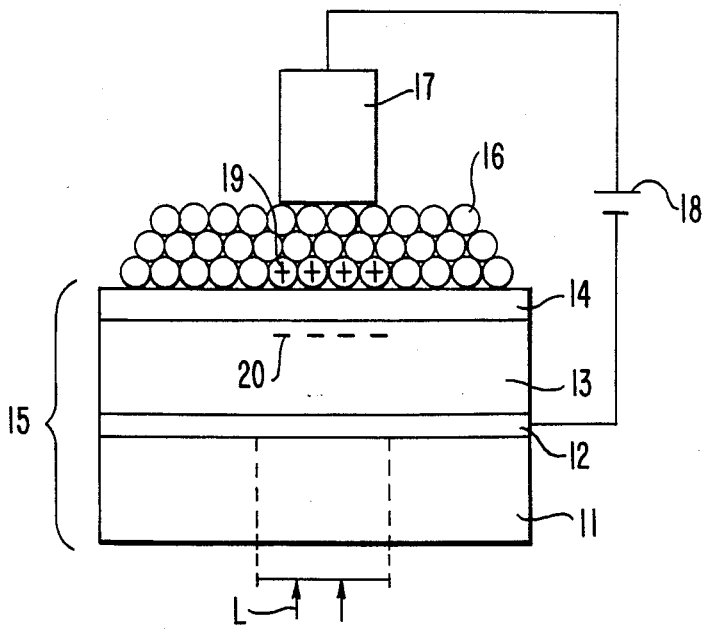
FIG. 2. (PRIOR ART)
FIG. 2 is a schematic, elevational view of prior art apparatus for illustrating a method of electrophotographic printing which does not require the use of a corona discharging device.
Figure 3:
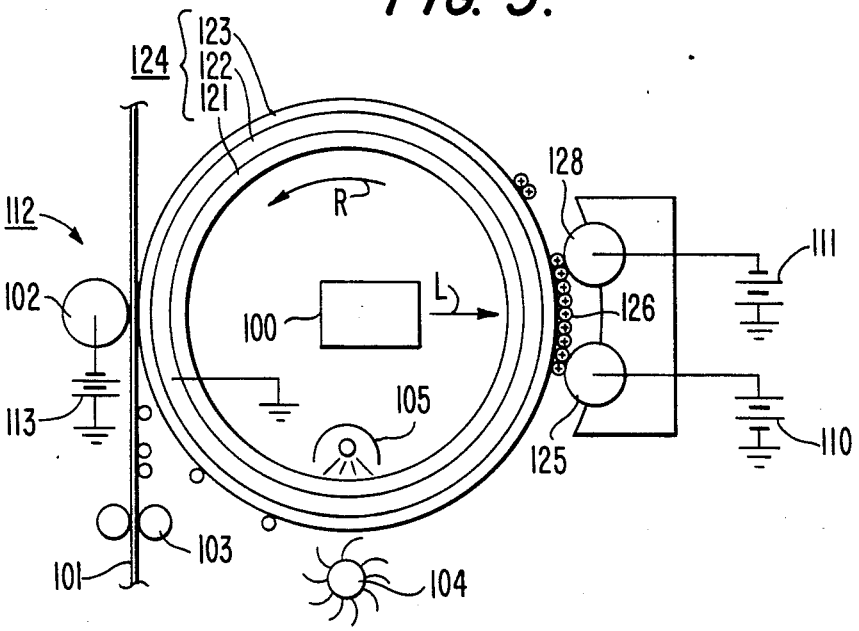
FIG. 3 is a schematic, end elevational view of electrophotographic apparatus in accordance with a first embodiment of the invention for performing image processing and electrophotographic printing.

FIG. 3 is a simplified schematic end elevational view illustrating a first embodiment of electrophotographic printing apparatus in accordance with the present invention. A first developer 125 and a second developer 128, such as magnetic brush developers, are positioned with a predetermined spacing therebetween, in facing relationship with the cylindrical outer surface of a photosensitive recording drum 124. The drum 124 rotates at a constant speed in the direction indicated by arrow R. The cylindrical sidewall of the drum 124 comprises a laminate of a transparent supporting layer 121, a transparent conductive layer 122 which functions as an electrode, and a photoconductive layer 123. A voltage source 110 is connected at its positive terminal to the first developer 125, such that the latter supplies positively charged nonconductive toner particles 126 onto the surface of the photosensitive drum 124; as described later, negative charges are injected into the photoconductive layer 123 and reach a trapping potential close to the surface of the photoconductive layer 123, forming a latent electrostatic image of the object to be printed, and producing an electric field which adheres the positively charged toner particles 126 to the surface of the photoconductive layer 123, the latter comprising, as well, the outer surface of the drum 124.

An optical source 100 emits an optical beam, such as a laser beam, which is controlled to scan the image of an object on the inner surface of the photosensitive drum 124 and particularly that of the transparent supporting layer 121. The source 100 may comprise, as an example of known structure, a semiconductor laser functioning as a laser beam emitter, a rotating polygon for scanning the laser beam, and several optical elements, as in known laser printers (and thus not shown in detail in the drawing). The laser beam thus is projected against the inner surface of the supporting layer 121, as indicated by an arrow L. As above noted and explained in detail hereafter, the laser beam results in negative charges being injected into the photoconductive layer 123 and which reach a trapping potential which exists close to the surface of the photoconductive layer 123, the trapping potential maintaining the negative charges trapped at that location at which they remain after exposure by the laser beam is terminated.

At a subsequent time, determined by the rate of rotation of the drum 124 in the direction R and the spacing between the developers 125 and 128, a voltage of opposite or reverse polarity is applied to the toner particles 126 by the developer 128 from power source 111, which thereby releases the toner particles 126 on the nonexposed portion of the photosensitive drum 124. The toner particles on the exposed portion of the photoconductive layer 123 of drum 124, however, remain adhered to the surface due to the continued presence of the trapped negative charges, as before explained. Thus, a toner image is formed and retained on the surface of the drum 124, which continues to rotate in the direction R and thus transports the toner image to a transfer station 112 at which the retained, charged particles 126 forming the toner image are transferred to recording paper 101. Particularly, the recording paper 101 may comprise plain paper which is engaged against the surface of the drum 124 by a transfer roller 102, formed of a conductive rubber. The roller 102 is charged by source 113 to an opposite, or negative, potential relative to the positive charge of the particles 126. Due to the reverse polarity effect, the toner image is released from the surface of the photosensitive drum 124 and transferred onto the paper 101. The recording paper 101 then proceeds between a pair of pressure rollers 103 which serve to fix the transferred toner image on the recording paper 101. A brush cleaner 104 and a discharge lamp 105 function to remove any remaining toner particles from the surface of the drum 124. Continued rotation of the drum 124 then permits continuous recycling of the printing operation, as described.

Figure 4A:
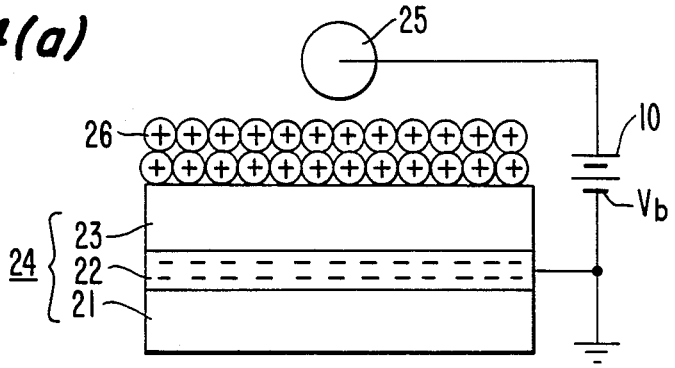
FIGS. 4(*a*) to 4(*c*) are schematic, end elevational views of segments of a laminated photosensitive medium, which may correspond to the photosensitive medium employed in the apparatus of FIG. 3, representing successive stages of the imaging process in accordance with the first embodiment of the invention and including, respectively, a first developing stage, an exposure stage, and a second developing stage.
Figure 4B:
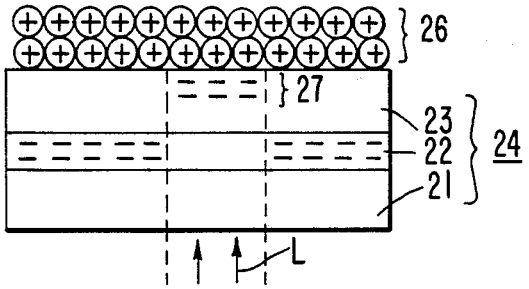
Figure 4C:
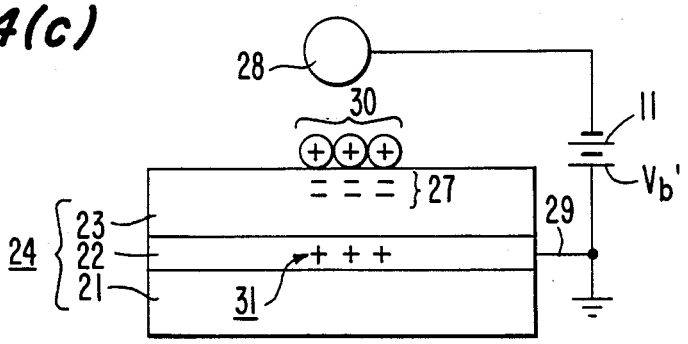

In each of the FIGS. 4(*a*) through 4(*c*), 5, 6, 7(*a*) and 7(*b*), for simplicity of illustration, a segment of the cylindrical sidewall of a photosensitive drum of the type of drum 124 shown in FIG. 3 is illustrated as a flat, planar laminated structure, and is referred to as a photosensitive medium.

Figure 5:
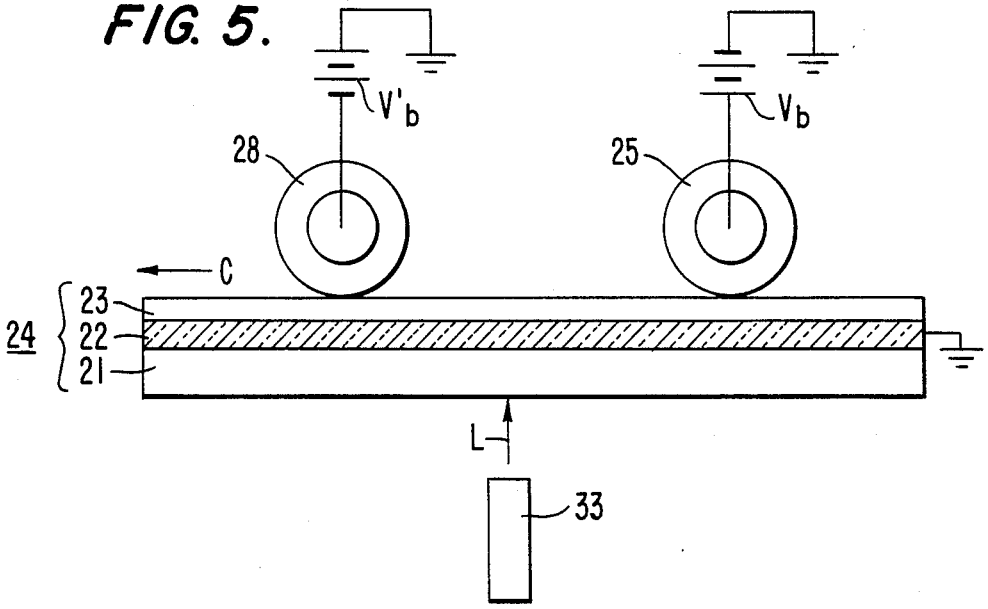
FIG. 5 is a schematic, simplified elevational view of an extended, continuous segment of the laminated photosensitive medium of FIGS. 4(*a*) to 4(*c*), illustrating the relative relationship therewith of developer and scanning light beam exposure apparatus for performing the imaging process in accordance with the first embodiment of the invention.

A first embodiment of the present invention is illustrated in FIGS. 4(*a*) to 4(*c*) and FIG. 5, to which the following description relates. In FIG. 4(*a*), the photosensitive medium 24 comprises a supporting layer 21 of polyethylene-terephtaleit of approximately 75 μm thickness, a transparent conductive layer 22 of ITO, of approximately 0.2 μm thickness, and an organic photoconductive layer 23 of approximately 60 μm thickness having trapping potential levels therein. The transparent conductive layer 22 is deposited on the supporting layer 21 by a conventional evaporation method, and the photoconductive layer 23 thereafter is coated onto the transparent conductive layer 22, likewise in conventional fashion. A first developer 25 (FIG. 4(*a*)) and a second developer 28 (FIG. 4(*c*)) are disposed adjacent the surface of the photosensitive medium 24 defined by the photoconductive layer 23 and are displaced from each other, as illustrated in FIG. 5, by a distance of approximately 2 to 3 centimeters. As illustrated in FIG. 3, the actual displacement would be determined relatively to the circumference of the cylindrical surface defined by the photoconductive medium 24, in a practical device.

Each of the developers 25 and 28 may comprise a magnetic brush developer having a rotatable sleeve which rotates at a tangential speed of approximately 30 cm/sec. The surface of the photosensitive medium 24, in its normal cylindrical configuration, is transferred past the developers 25 and 28 in the direction indicated by arrow C in FIG. 5, at a speed of approximately 10 cm/sec.

The photoconductive material employed in the cylindrical sidewall laminate of the photosensitive drum employed in each of the embodiments of the invention as disclosed herein, such as particularly the layer 23 in FIGS. 4(*a*) through 5, is a specially prepared organic photoconductive material. The layer more particularly has a series of internal trapping potentials disposed adjacent one of its surfaces—i.e., the upper surface thereof as shown in FIGS. 4(*a*) to 4(*c*). As a result, an electrical field of a specialized energy level is required for charges or electrons traversing the layer 23 to "jump" over the trapping, as discussed hereafter in more detail in relation to FIG. 4(*b*). A photoconductive layer having such potential traps close to one of its surfaces can be fabricated in various known ways in accordance with its intended usage. A specific example of a suitable photoconductive or photosensitive material is available from Kodak Company under the brand name SO-102.

Any of various types of photoconductive material, which satisfy the following conditions, may be employed as the photoconductive layer in a photosensitive drum as employed in accordance with the present invention:

(a) electrical charges traversing the photoconductive layer in a direction toward the surface of the layer on which charged toner particles are disposed, must never combine with the charges carried by the toner particles thereon such that the charges are neutralized; and (b) charges which are fixed or trapped in the photoconductive layer, subsequently to completion of exposure by the optical beam, must maintain a stable position, and not move or be dispersed, despite the effect of the second developor electrical field, until the subsequent completion of the second developing process, usually a period of approximately 10 milliseconds.

With reference to FIG. 4(*a*), toner particles 26 are transferred onto the surface of the photoconductive layer 23 by a first magnetic brush developer 25, to form a uniform, charged toner particle layer. The developing particles comprise two components, consisting of nonconductive toner particles 26 made from insulative plastic material of approximately 10 μm in diameter, and carrier particles of iron of approximately 10 to 200 μm in diameter. Moreover, there are two types of nonconductive toners, magnetic and nonmagnetic. In the presently described, first embodiment of the invention, nonconductive toners of the nonmagnetic type are employed. As described in reference to other embodiments of the invention, nonconductive toners of the magnetic type may also be employed, in accordance with the invention. The weight ratio of the nonconductive toner particles with respect to the total weight of developing particles is approximately 1:10 or 10%, and the specific charge density is approximately 10 μCoulomb/g.

Voltage source 10 supplies a positive DC voltage, $V_b$, of approximately 500 V relative to the grounded transparent conductive layer 22, which is applied to the first developer 25, creating a Coulomb force which attracts the toner particles 26 to the transparent photoconductive layer 23, in a dark chamber of the first developer 25. Due to the positive polarity of the voltage $V_b$ applied to the first developer 25 and the insulative characteristic of the photoconductive layer 23, negative charges are induced in the transparent conductive layer 23, as illustrated in FIG. 4(*a*). The quantity per unit area (kg/m$^2$), $M_b$, of the adhered, charged toner particles 26 is represented by the following equation:

$$M_b=\delta p\{-(\epsilon_r d/\epsilon_d)+((\epsilon_r d/\epsilon_d)^2+2\epsilon_o\epsilon_r V_b/\rho_b)^{\frac{1}{2}}\} \quad (1)$$

where, δ denotes mass of the toner particles, p denotes the packing density of the toner particles, $\rho_b$ deontes the charge density of the adhered toner particles, $\epsilon_o$ denotes the dielectric coefficient of a vacuum, $\epsilon_r$ denotes a relative dielectric coefficient of the toner particles, and d denotes the thickness of the photosensitive layer. The quantity Q of electric charges of the toner particle layer is given by the equation (2), $$Q=\delta p\cdot q/m\{-(\epsilon_r d/\epsilon_d)+((\epsilon_r d/\epsilon_d)^2+2\epsilon_o\epsilon_r V_b/\rho_b)^{\frac{1}{2}}\} \quad (2)$$

Recalling again the continuous transport of the photosensitive medium 24, such as by rotation of its actual drum configuration in accordance with the illustration of FIG. 3, the portion of the photosensitive medium 24 having a uniform, adhered layer of charge particles 26 thereon is transported to the light exposure station, at which the medium 24 is exposed from the lower (or interior) surface by a laser beam indicated by the arrows L in FIG. 4(*b*). The laser beam L may be generated by a helium-neon laser source 33, illustrated in FIG. 5, of approximately 0.8 mW. In known fashion, the laser beam is scanned over the inner surface of the medium 24 in accordance with an image pattern to be printed. The selective exposure of portions of the photoconductive layer 23 causes a reduction in the level of resistivity in those portions, with the result that the negative charges induced in the transparent conductive layer 22 in the regions scanned by the laser beam L traverse through the photoconductive layer 23 to positions just beneath the upper surface thereof, as illustrated at 27 in FIG. 4(*b*), at which position the negative charges are trapped by the trapping potential level established in the photoconductive layer 23. Upon extinguishing the laser beam (and, in a practical application, as the beam proceeds to a different location or area for continued scanning of the desired image), the photoconductive layer 23 resumes its normally insulative condition, or state, thus fixing the negative charges 27 at the potential-trap position. As a result, a latent electrostatic image is formed by the trapped negative charges in the scanned area as indicated by the charges 27 in FIG. 4(*b*).

The photosensitive medium 24, in the state established in FIG. 4(*b*), due to continuous transport movement then advances to the second developor station employing the second developer 28, as illustrated in FIG. 4(*c*). A source 11 supplies a negative DC bias voltage, $V_b'$, of a value of approximately $-100$ V with respect to the transparent conductive layer 22, to the second developer 28. As is apparent, the voltage $V_b'$ is of the reverse, or opposite, polarity relative to that of the voltage $V_b$. This produces a resultant Coulomb force in the reverse direction to that of the first developer station, which causes the charged toner particles to be released gradually from the nonexposed portions of the surface of the photoconductive layer 23 and be collected by the second developer 28. The induced negative charges in the nonexposed portions of the transparent conductive layer 22 move gradually to the node 29, schematically indicated to be grounded in FIG. 4(*c*), and thus are discharged.

The second developing step of FIG. 4(*c*) has the further effect of removing a portion of the positively charged toner particles 26 which were initially caused to adhere to the surface by the Coulomb force produced in the first developing step of FIG. 4(*a*) and selectively caused to adhere in the exposure step of FIG. 4(*b*). There results a reduced number of positively charged toner particles 26 on the selectively exposed surface areas, as illustrated at 30 in FIG. 4(*c*). The mechanism by which this result occurs is as follows. The Coulomb force generated by the reverse DC voltage $V_b'$ of FIG. 4(*c*) opposes and thus reduces the level of the attracting force produced by the electric field created by the negative charges 27 which are trapped in the photoconductive layer 23. As a result, a portion of the initially adhered toner particles 26 is released. Since the negative charges 27 remain trapped firmly in the photoconductive layer 23 and thus are stable and not capable of moving, new positive charges 31 are induced in the transparent conductive layer 22, corresponding to the amount of the positive charges lost by the release of toner particles 26. Since the electrical, capacitance of the photoconductive layer 23 is relatively small, the newly induced positive charges 31 generate a relatively high potential field in a direction opposing that of the externally applied voltage from the source 11; accordingly, charged toner particles 26 are released until the surface potential of the photoconductive layer 23 comes into an electrical balance with the exterior voltage $V_b'$ applied to the second developer 28 from source 11. Thus, a significant portion of the initial quantity of charged particles 26 in the exposed area, as illustrated in FIG. 4(*b*), remains on the surface of the photoconductive layer 27 when the balanced surface potential condition is reached; this is indicated in FIG. 4(*c*) by the remaining, charged toner particles 30 which continue to adhere to the surface due to the attracting force of the trapped negative charges 27 and the positive charges of those remaining toner particles 30. The remaining toner particles 30 thus provide a visual toner image.

The quantity per unit area (kg/m$^2$) of the remaining toner particles 30 on the exposed portion of the photoconductive layer 27 is calculated by the following equation:

$$M_{ob}=\delta p\{-(\epsilon_r d/\epsilon_d)+((\epsilon_r d/\epsilon_d)^2+2\epsilon_o\epsilon_r/\rho_b\cdot(V_b'+Q\cdot d/\epsilon_o\epsilon_r))^{\frac{1}{2}}\} \quad (3)$$

In equation (3), the value Q is given by equation (2). The fourth term of equation (3) represents the potential of the latent image formed by the trapped negative charges 27. The latent image potential is usually sufficiently higher than the second developing voltage $V_b'$ (which, as seen from FIG. 4(*c*) and discussed above, is a negative value), such that a clear toner image having an optical density (OD) greater than 1.0 is obtained, which is sufficient for practical printing purposes.

Particularly, the optical density, OD, of a surface is defined by the following equation:

$$OD=-\log_{10}(I_r/I_i) \quad (4)$$

wherein $I_i$ and $I_r$ respectively denote the intensities of incident light and reflected light at the relevant surface. The value of OD = 1 corresponds to an optical reflectivity of approximately 10%. Usually a value of OD > 1 is required for printed figures.

The embodiment of the invention as thus described in conjunction with FIGS. 3 and 4(*a*)–4(*c*) has been disclosed in the context of employing nonconductive (i.e., insulative), two-component toner particles and, particularly, such toners employing nonmagnetic, nonconductive toners. However, magnetic nonconductive toners also may be used. Magnetic nonconductive toners offer the advantage that the same are released more easily from the nonexposed portions of the surface of the photoconductive layer 23, than are nonmagnetic nonconductive toners, with the aid of a magnetic field applied by the second developer 28. In this circumstance, the absolute value of the relevant second bias voltage $V_b'$ can be reduced significantly, almost to 0 V, with the result that the quantity per unit area of the charged toner particles 30 in FIG. 4(*c*) which remains adhered to the surface may be significantly increased, affording a higher OD and thus a clearer, retained toner image which may be transferred thereafter to a recording paper. As an alternative consideration, the use of magnetic nonconductive toners affords greater freedom in selecting the value $V_b'$ of the second developer voltage, while retaining a sufficient number of charged particles 30 to afford an acceptable OD toner image.

Figure 6:
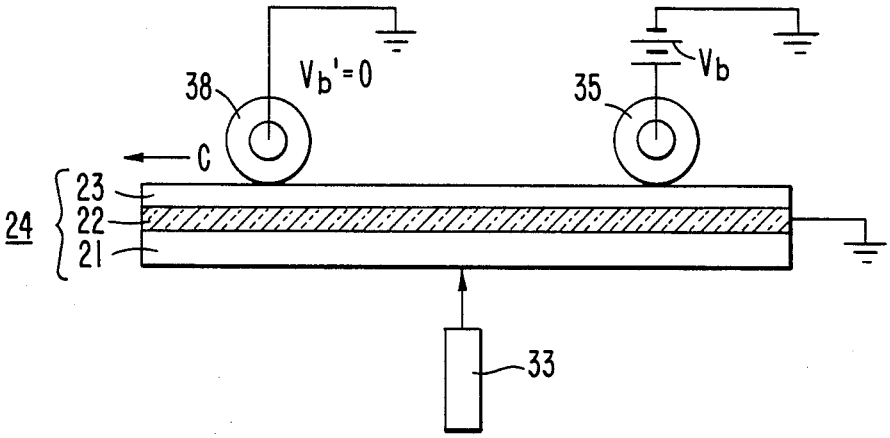
FIG. 6 is a schematic, simplified elevational view, corresponding to that of FIG. 5, illustrating an alternative arrangement of the associated photosensitive medium, and of developer and scanning light beam exposure devices, in accordance with a second embodiment of the invention.

A second embodiment of the present invention is disclosed and described in reference to FIG. 6. Whereas the first embodiment of the invention employed nonconductive toner particles, as above described, providing the significant advantage in practical use that the developed toner image may be transferred onto plain recording paper, conductive toners also can be employed in electrophotographic printing systems in accordance with the present invention. Particularly, the second embodiment differs from the first embodiment in the following respects:

(a) the toner particles, rather than being nonconductive, are conductive and have a resistivity of approximately $10^6$ Ohm. cm;

(b) a positive DC voltage, $V_b=200$ V, is applied to the first developer 35 whereas the second developer 38 is maintained at ground potential, i.e., $V_b'=0$, the same ground or reference potential to which the transparent conductive layer 22 is connected.

With reference to FIG. 6, the photosensitive medium 24 as in FIGS. 4(*a*) to 5, moves in the direction C past first and second developers 35 and 38, respectively maintained at the voltages $V_b=200$ V (approximately) and $V_b'=0$ V (i.e., ground). In a manner similar to that explained with regard to the first embodiment and FIGS. 4(*a*) through 4(*c*), the first developer 35 causes positively charged conductive toner particles to be applied as a uniform layer on the surface of the photoconductive layer 23. Likewise, negative charges are induced in the transparent conductive layer 22, corresponding to the positive charges of the applied toner particles.

The photosensitive medium 24 then advances to the exposure station at which laser source 33 selectively illuminates the medium 24 from the opposite surface, reducing the resistivity of the exposed portions of the photoconductive layer 23. Negative charges induced in the transparent conductive layer 22 thereby travel into the photoconductive layer 23 to a position just below the upper surface thereof, at which the negative charges are trapped by a trapping potential barrier established in the photoconductive layer 23. When the thus exposed portions of the medium 24 are advanced further in the direction C and thus beyond the exposure station, or, equivalently, when the light beam from the laser source 33 is extinguished, those previously exposed portions of the photoconductive layer 23 return from a conductive to an insulating state, thus fixing the negative charges in their positions just beneath the upper exposed surface of the photoconductive layer 23.

Thereafter, as the medium 24 advances to the second developer station housing the developer 38, the charges in the toner particles are discharged to ground through the second developer 38. In this regard, it should be understood that the toner particles, while conductive and thus, as a uniform layer, electrically interconnecting the developers 35 and 38, have sufficient resistivity such that little current is allowed to flow through the layer of toner particles connecting the developers 35 and 38. The toner particles on the nonexposed portions of the photoconductive layer 23 then are released gradually and collected by the second developer 38. The corresponding negative charges in the layer 22 are discharged to ground through the ground connection.

Similarly to the phenomenon described in accordance with the first embodiment of the invention, a portion of the charged toner particles retained on the exposed portions of the photoconductive layer 23 also is released by the second developer 38, inducing a corresponding level of positive charges in the conductive layer 22, because of the negative charges trapped and fixed in the photoconductive layer 23. In a similar potential balancing function as before described, the induced positive charges in the layer 22 generate a potential which acts to decrease the surface potential of the photoconductive layer 23 to a level at which it comes in balance with the ground voltage $V_b'=0$ of the second developer 38. At this juncture, the second developing step is completed, the positively charged toner particles remaining adhered on the exposed portions of the photoconductive layer 23 as a result of the Coulomb force produced by the negative charges trapped and fixed in the photoconductive layer 23. The optical density of the toner image thus produced is greater than 1.0 and is sufficient for practical printing purposes. Moreover, the background density is of a very low level, yielding good toner image contrast.

Figure 7A:
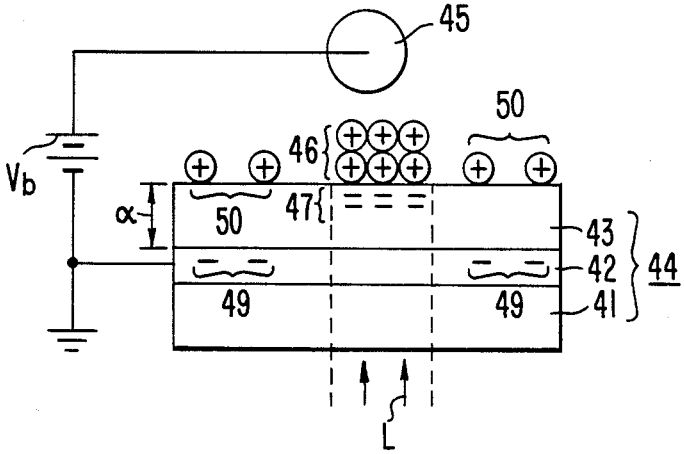
FIGS. 7(*a*) and 7(*b*) are schematic, simplified elevational views of a photosensitive medium and of associated developer and scanning light beam exposure stations for performing an imaging process in accordance with a third embodiment of the invention, FIG. 7(*a*) illustrating an arrangement of apparatus for performing simultaneous first developing and light beam exposure steps and FIG. 7(*b*) illustrating apparatus for performing a second developing step.
Figure 7B:
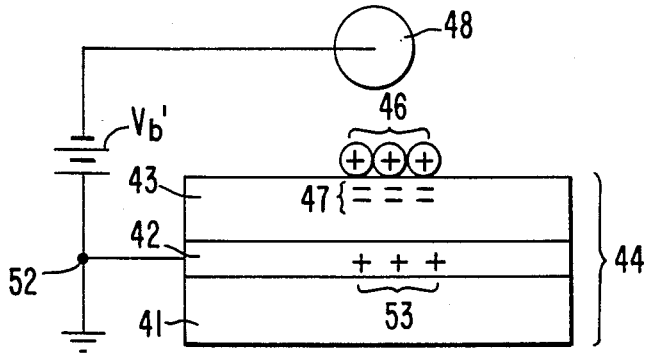

A third embodiment of the present invention is shown in the simplified schematic, elevational views of FIGS. 7(*a*) and 7(*b*). This third embodiment comprises, essentially, a modification of the first embodiment; particularly, the steps of applying a first developer bias voltage to the charged toner particles on the surface of the photosensitive medium and the step of exposing the photosensitive medium from the opposite surface thereof by an optical beam are performed simultaneously, rather than in succession as in the first embodiment.

The photosensitive medium 44 comprises a transparent supporting layer 41, a transparent conductive layer 42, and a photoconductive layer 43, each of which may be the same as the corresponding layers of the photosensitive medium 24 of FIG. 4(*a*). It is to be understood in this regard that the laminate photosensitive medium 44 of FIGS. 7(*a*) and 7(*b*) is a continuous medium, such as the cylindrical sidewall of a photosensitive drum, but which is shown in separate planar segments with respect to FIGS. 7(*a*) and 7(*b*) for ease of illustration.

As shown in FIG. 7(*a*), the first developer 45 is maintained at a positive DC potential, $V_b$, relative to a ground potential of the conductive layer 42. With reference to FIG. 7(*b*), a second developer 48, positioned a predetermined distance from the first developer 45 of FIG. 7(*a*), is maintained at a negative DC potential $V_b'$, relative to the conductive layer 42. The first magnetic brush developer 45 deposits a uniform layer of positively charged two-component developing particles onto the surface of the photoconductive layer 43, the components consisting of nonconductive toner particles 46 and carrier particles. The nonconductive toner particles may be the same material employed in the first embodiment and which are positively charged by the magnetic brush developer 45 by mutual friction, prior to being deposited thereby in a uniform layer, as illustrated. A positive DC voltage $V_b$, for example of 500 V, relative to the reference potential of the transparent conductive layer 42, is applied to the first developer 45 and functions, in a conventional dark chamber of the first developer 45, through a Coulomb force to attract the positively charged toner particles 46 to the transparent photoconductive layer 43. The positively charged toner particles 46 induce negative charges in the transparent conductive layer 42.

Simultaneously with the deposit of the charged toner particles, a laser beam, indicated by arrows L and emitted by a helium-neon laser source of approximate 0.8 mW, is scanned onto the reverse surface of the medium 44 in accordance with the pattern of an image to be printed. As a result, the resistivity of the selectively exposed portions of the photoconductive layer 43 is reduced. The negative charges induced in layer 42 are attracted by the positively charged toner particles 46 which currently are being deposited on the surface of the photoconductive layer 43, and proceed to a level just beneath the exposed surface of the photoconductive layer 43 and become trapped therein by the potential trapping levels within that layer 43. Accordingly, the surface potential of the exposed surface of the photoconductive layer 43 approaches closely the potential of the transparent conductive electrode 42. The pattern of negative charges, thus established immediately underlying the exposed surface of the photoconductive layer 43, creates a strong Coulomb force, correspondingly strongly adhering the positively charged toner particles 46 to the immediately adjacent exposed surface of the photoconductive layer 43. As a result, the quantity of the adhered toner particles 46 is significantly increased, relative to that produced by the technique of the first embodiment, as represented by the following equation:

$$M_b=\delta p(2\epsilon_o\epsilon_r V_b/\rho_b)^{\frac{1}{2}} \quad (5)$$

where, $\delta$, p, $\epsilon_o$ and $\rho_b$ denote, respectively, like terms as those denoted in equation (1). As is apparent, equation (5) can be obtained by substituting d=0 in equation (1).

As illustrated in FIG. 7(*a*), there are thus developed in the layer 43, charges 47 which are equal in total charge but opposite in polarity to the charge of the toner particles 46 (the former being negative and the latter being positive, in this example), which opposite polarity charges are insulated from each other by a barrier potential of the photoconductive layer 43. Thereafter, upon extinguishing the laser beam L, the photoconductive layer 43 becomes insulating and the negative charges 47 thereafter remain fixed in their trapped positions. The oppositely charged toner particles 46 thus remain fixed on the exposed portions of the surface of the photoconductive layer 43. With respect to the portions of the surface of the photoconductive layer 43 which were not exposed by the beam L, a limited quantity of charged toner particles 50 remain attracted thereto by the effect of the voltage $V_b$ applied to the first developer 45, relative to the ground potential of the conducting layer 42, thus inducing negative charges 49 of corresponding amount in the transparent conductive layer 42. The quantity per unit area of the positively charged toner particles 50 on the nonexposed surface areas is given by equation (1), as in the first embodiment.

When the photosensitive medium 44 is shifted to the second developing station 48, as illustrated in FIG. 7(*b*), a negative DC bias voltage, $V_b'=-100$ V (approximately), is applied to the second developer 48, relative to the transparent conductive layer 42; as illustrated, the layer 42 is electrically connected to node 52 corresponding to the positive potential terminal of the source $V_b'$. Thus, the polarity of the voltage established between layer 42 and the second developer 48 is opposite that established at the station of the first developer 45. Correspondingly, the resultant Coulomb force likewise is reversed, causing the positively charged toner particles 46 and 50 (i.e., in FIG. 7(*a*)) to be released gradually from the surface of the photoconductive layer 43 and be collected by the second developer 48. The negative charges 49 induced in the nonexposed portions of the transparent conductive layer 42 then gradually move to the node 52, which is maintained at system ground potential, and correspondingly the remaining positively charged toner particles 50 on the nonexposed surface portions are removed.

As illustrated in FIG. 7(*b*), and by comparison with FIG. 7(*a*), a portion of the positively charged toner particles 46 remain adhered to the exposed surface portions of the layer 43, by the same mechanism or phenomenon as described with reference to the first embodiment and illustrated in FIG. 4(*c*); in that context, the positive charges 53 in FIG. 7(*b*) correspond to the positive charges 31 illustrated in FIG. 4(*c*). Thus, a substantial portion of the initial charged toner particles 46, as initially and uniformly disposed on the exposed portions of the surface of the layer 43, remain adhered to that surface 43 by the attracting Coulomb force established by the trapped negative charges 47. Thus, the latent electrostatic image is developed into a visual toner image. The quantity per unit area, $M_{ob}$, of the positively charged toner particles 46 remaining adhered to the exposed portions of the surface of photoconductive layer 43 is given by the following equation:

$$M_{ob}=\delta p\{-(\epsilon_r d/\epsilon_d)+((\epsilon_r d/\epsilon_d)^2+2\epsilon_o\epsilon_r(V_b'+\rho_b(2\epsilon_o\epsilon_r V_b/\rho_b))^{\frac{1}{2}}\times d/(\epsilon_o\epsilon_d)/\rho_b)^{\frac{1}{2}}\} \quad (6)$$

The fourth term of equation (6) represents the potential of the latent image established by the trapped negative charges 47 and which, since significantly higher than the exterior potential $V_b'$, produces a clear toner image.

Figure 8:
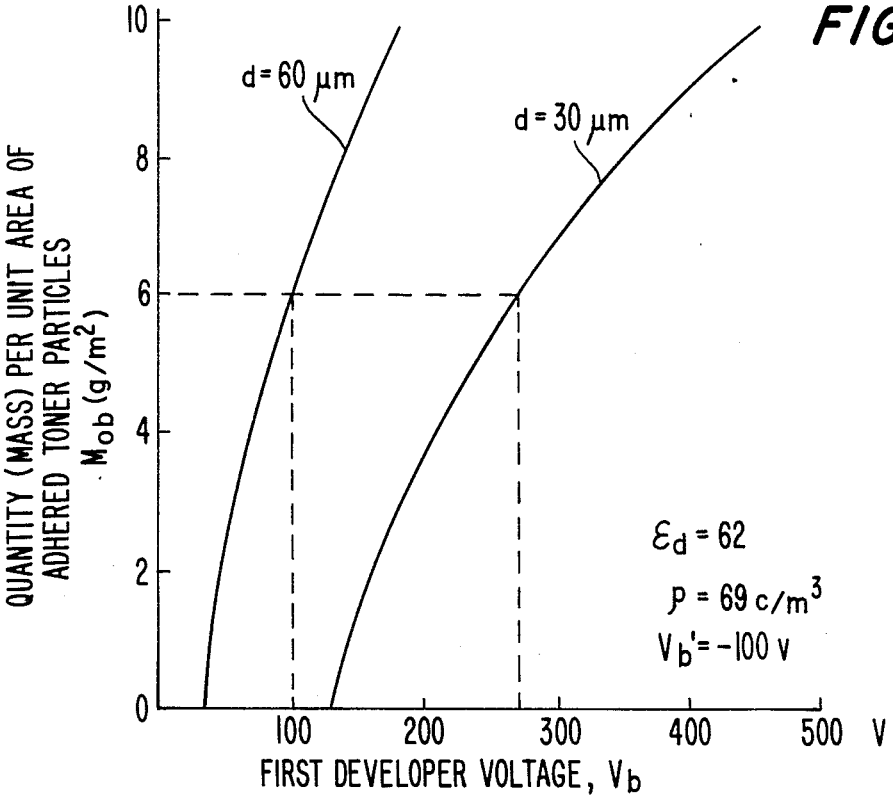
FIG. 8 is a graph illustrating the results of calculations relating the quantity per unit area of toner particles which adhere to the surface of a photosensitive medium in relation to the magnitude of a first developing voltage, in accordance with the third embodiment of the invention.

The relationship between the quantity of the charged toner particles retained on the exposed surface portions of the photoconductive layer 43 and the potential level of the first developer voltage, $V_b$, as calculated by equation (6), is plotted in FIG. 8, wherein the following values of parameters of the equation are used:

charge-to-mass ratio of toner particles: q/m=10 $\mu$C/g;
packing density of the toner particles: p=0.6;
mass density of the toner particles: 1.15 g/cm$^3$;
relative dielectric constant of toner particles: $\epsilon_r=2.2$;
relative dielectric constant of organic photoconductor: $\epsilon_d=6.2$; and
second developer bias voltage: $V_b=-100$ V.

Moreover, the charge density of the toner layer, $\rho_b$ is given by $$\rho_b=\epsilon p(q/m) \quad (7)$$

From the plots of FIG. 8, it can be seen that to obtain a quantity per unit area of adhered toner particles, of $M_{ob}=6$ mg/m$^2$ for d=60 $\mu$m, a value of $V_b=100$ V for the first developer voltage must be employed, and at d=30 $\mu$m, a value of $V_b=275$ V for the first developer voltage is required. Since for practical purposes, the photocondutive layer should be approximately 30 $\mu$m in thickness and since a toner particle density (i.e., quantity, or mass, per unit area) greater than 6 mg/m$^2$ is required, a value of the first developer voltage, $V_b$, in excess of 300 V should be employed. There results a relatively high optical density (OD), greater than 1.0, of the toner image thus formed, which is sufficient for practical printing purposes.

Figure 9:
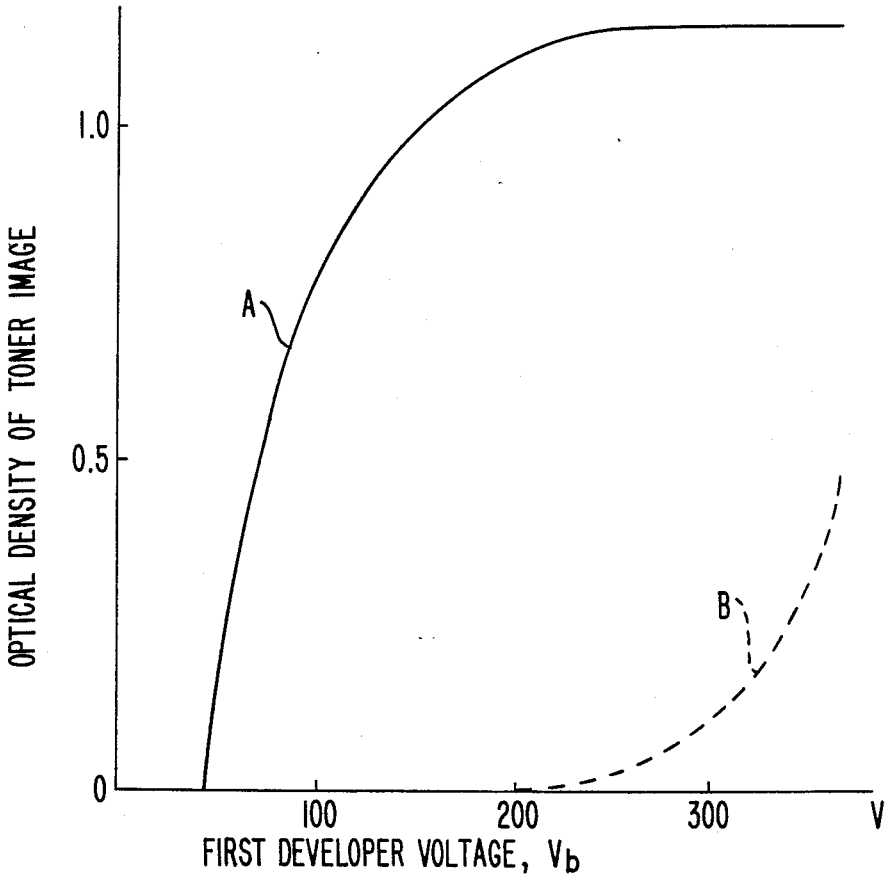
FIG. 9 is a graph of data, based on experimental results, relating the optical density of a toner image to the magnitude of the first developer voltage, in accordance with the practice of the imaging method of a fourth embodiment of the invention.

In accordance with a fourth embodiment of the present invention, comprising a modification of the third embodiment, just described, single component, conductive magnetic toner particles are employed, using a first developer voltage, $V_b=150$ V (approximately), relative to a second developer voltage $V_b'=0$ V. With these exceptions, the apparatus, parameters and other operating features are the same. Experimental results employing the fourth embodiment of the invention are illustrated in FIG. 9, which comprises a plot defining a curve A representing the relationship between the optical density (OD) of the toner image and the first developer voltage, $V_b$. The curve B, shown in a dotted line, represents the optical density of the background, i.e., the nonexposed portions of the surface of the photoconductive layer. As can be ascertained from FIG. 9, a first developer voltage $V_b$, in the range of from 100 V to 200 V, produces a sufficient optical density (OD) of the toner image of approximately OD=1.0 or greater, with almost no detectable background density, corresponding to which a clear toner image with good delineation and contrast relative to the background may be obtained—employing, nevertheless, relatively low developer voltages.

Figure 10A:
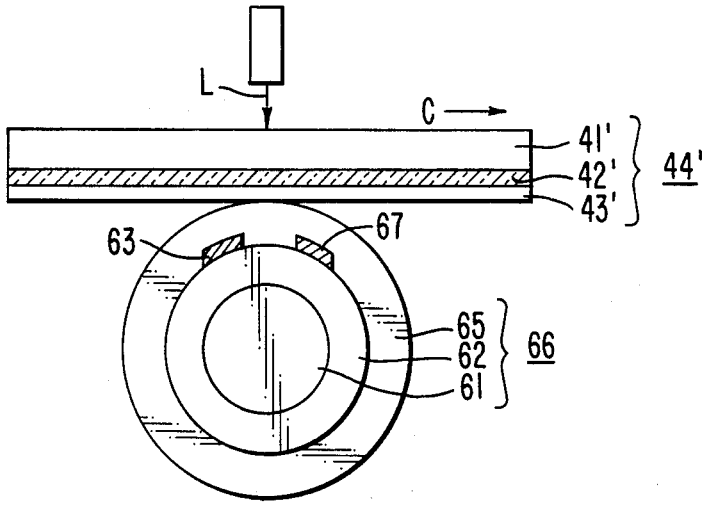
FIG. 10(*a*) is a schematic, simplified end elevational view of an improved, simplified unitary apparatus performing the functions of first and second developer stations of prior art apparatus, in conjunction with a laminated photosensitive medium of planar configuration and exposing light beam source, which may be employed to perform the developing steps in accordance with the process of the invention, and FIG. 10(*b*) is a simplified, perspective view of the unitary apparatus of FIG. 10(*a*).
Figure 10B:
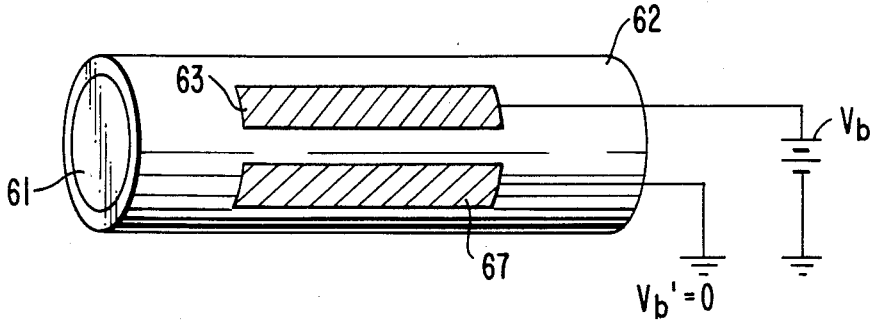

In the foregoing description of the various embodiments of the present invention, consistent with the schematic illustrations of the figures, two independent developers, each comprising a conventional magnetic brush developer, are disclosed for developing the latent electrostatic image on the selectively exposed portions of the surface of a photosensitive medium. However, the structure and function of the previously discussed, two independent developers may be replaced by a new type of developer 66 illustrated in FIGS. 10(*a*) and 10(*b*). Both FIGS. 10(*a*) and 10(*b*) comprise schematic illustrations, the former comprising a cross-sectional view and the latter, a perspective view, of the developer 66. More particularly, and with concurrent reference to FIGS. 10(*a*) and 10(*b*), the developer 66 comprises a fixed sleeve 62 having a hollow cylindrical configuration and made of a nonmagnetic material, and a magnetic roller 61 therewithin, of a solid cylindrical configuration, and free to rotate within the sleeve 62. Elongated electrodes 63 and 67 are formed on the cylindrical surface of the sleeve 62 at angularly displaced positions extending in generally parallel, axial directions. A magnetic brush 54 (designating the periphery of the brush tips) lightly engages the surface of layer 43, in conventional fashion.

The magnetic roller 61 in driven in rotation within the fixed sleeve 62 at a tangential speed of approximately 30 cm/sec. A photosensitive medium 44' comprising a laminate of layers 41', 42' and 43', respectively corresponding to the laminated layers 41, 42 and 43 of the medium 44 of FIGS. 7(*a*) and 7(*b*), but in this instance of a planar configuration, is transported in a direction designated by arrow C perpendicular to the axis of the cylindrical developer 66 and in closely spaced relationship to the electrodes 63 and 67, at a speed of approximately 10 cm/sec. A first developer voltage $V_b$ is applied to the electrode 63 and a second developer voltage $V_b'$, of ground potential (i.e., $V_b'=0$ V), is applied to the second electrode 67. The electrodes 63 and 67 thus function as independent, first and second developers operated at respective developer voltages corresponding to those of developers 35 and 38 of the second embodiment, of FIG. 6.

In each case in which the second developing process uses conductive or nonconductive toner particles, any suitable conductive element, such as a metal roller, may be used as the second developer, instead of a magnetic brush developer, since the second developer need function only to apply the required electric field to the layer of toner particles to remove particles from the nonexposed surface areas.

Many modifications and adaptations of the present invention, as has been disclosed herein with reference to specific preferred embodiments, will be apparent to those of skill in the art. Thus, it is intended by the appended claims to cover all such modifications and adaptations which fall within the true spirit and scope of the invention.

What is claimed is:

1. A method for forming a toner image of an object on the surface of a photosensitive medium, comprising:

providing a photosensitive medium comprising a laminate of a transparent conductive layer and a photoconductive layer, said photoconductive layer having a first surface laminated with said transparent conductive layer and a second surface defining the surface of said photosensitive medium on which the toner image is to be formed, said photoconductive layer defining trapping potential levels closely adjacent said second surface thereof;

at a first developing station, forming a layer of charged toner particles of a first polarity on said second surface of said photoconductive layer by a first developer means, induce applying a first voltage of the first polarity to said first developer means to cause the charged toner particles to adhere to said second surface of said photoconductive layer and induce corresponding charges of a second, opposite polarity in said transparent conducting layer;

at an exposure station, selectively exposing said photoconductive layer in accordance with the toner image to be formed by projecting a light beam through said transparent conducting layer and onto said first surface of said photoconductive layer, said exposed portions of said photoconductive layer being rendered conductive and permitting said charges of the second polarity in the portions of said transparent conductive layer corresponding to the exposed, conductive portions of said photoconductive layer to traverse therethrough and be trapped at positions closely adjacent said second surface of said photoconductive layer established by said trapping potential levels, said exposed portions of said photoconductive layer, upon cessation of exposure by the light beam reverting to a nonconductive state and fixing the negative charges in the trapped positions within said photoconductive layer, said fixed charges defining an electrostatic latent image of the object; and at a second developing station, applying a voltage to a second developer means of a level and polarity opposite in sense to that of said first voltage for removing said charged toner particles from said second surface of said photoconductive layer in those portions not exposed by the light beam, the toner particles corresponding to the electrostatic latent image remaining adhered thereto and comprising the toner image of the object.

2. A method as recited in claim 1, further comprising performing said layer forming and said exposing steps simultaneously.

3. A method as recited in claim 1, wherein said toner particles comprise nonconductive material and said layer forming step further comprises charging said nonconductive toner particles with charges of said first polarity by subjecting said toner particles to mutual friction.

4. A method as recited in claim 1, wherein said toner particles comprise conductive material and said layer forming step further comprises charging said conductive toner particles with charges of said first polarity by subjecting said conductive toner particles to said voltage of said first polarity through said first developing means.

5. A method as recited in claim 1, wherein said selectively exposing step is performed prior to performing said removing step at said second developing station.

6. A method as recited in claim 5, wherein said exposing step is performed after said layer forming step.

7. A method as recited in claim 1, wherein said voltage applying step at said second developing station further comprises applying a voltage of opposite polarity to said second developing means.

8. A method as recited in claim 1, further comprising:

maintaining said transparent conducting layer at a reference potential; and applying said first voltage at said first developing station in said first polarity relative to said reference potential.

9. A method as recited in claim 8, wherein said step of applying said second voltage comprises maintaining said second developing means at said reference potential.

10. A method as recited in claim 8, wherein said step of applying said second voltage comprises applying a voltage of a level and polarity sense relative to said reference potential which is opposite that of said first voltage.

11. A method of forming a toner image of an object on the surface of a photosensitive medium, comprising:

providing a photosensitive medium comprising a laminate of a transparent conductive layer and a photoconductive layer, said photoconductive layer having a first surface laminated with said transparent conductive layer and a second surface defining the surface of said photosensitive medium on which the toner image is to be formed, said photoconductive levels defining trapping potential layers closely adjacent said second surface thereof;

transporting said photosensitive medium in sequence past first and second developing stations having respective first and second developer means;

applying a voltage of a first polarity to said first developer means at said first developer station for forming a layer of charged toner particles of a first polarity on said second surface of said photoconductive layer by said first developing means, said voltage of said first polarity causing said toner particles to adhere to said second surface of said photoconductive layer and inducing corresponding charges of a second, opposite polarity in said transparent conducting layer;

prior to the transport of said photosensitive medium with said layer of charged particles thereon past said second developing station, selectively exposing portions of said photoconductive layer in accordance with an image of the object by projecting a light beam through said transparent conductive layer and onto said photoconductive layer at said first surface thereof, for rendering said exposed portions conductive and permitting said charges of said second opposite polarity induced in said transparent conducting layer to be conducted therethrough to positions closely adjacent said second surface of said photoconductive layer, as established by said trapping potentials, said selectively exposed portions of said photoconductive layer, upon cessation of exposure thereof by said light beam, reverting to a nonconductive state for fixing said charges in said trapped positions therewithin, said fixed charges defining a latent electrostatic latent image of the object and tightly adhering the corresponding toner particles on said second surface of said photoconductive layer as a toner image of the object; and while transporting said medium having said latent electrostatic image thereon past said second developing station, applying a second voltage, of a polarity and sense opposite that of said first voltage to said second developer means for removing said charged toner particles from the second surface of said photoconductive layer in the nonexposed portions thereof, the charged toner particles corresponding to the electrostatic latent image remaining adhered thereto and comprising said toner image of the object are retained.

12. A method as recited in claim 11, further comprising performing said layer forming and said exposing steps simultaneously.

13. A method as recited in claim 11, wherein said toner particles comprise nonconductive material and said layer forming step further comprises charging said nonconductive toner particles with charges of said first polarity by subjecting said toner particles to mutual friction.

14. A method as recited in claim 11, wherein said toner particles comprise conductive material and said layer forming step further comprises charging said conductive toner particles with charges of said first polarity by subjecting said conductive toner particles to said voltage of said first polarity through said first developing means.

15. A method as recited in claim 11, wherein said selectively exposing step is performed prior to performing said removing step said at second developing station.

16. A method as recited in claim 15, wherein said exposing step is performed after said layer forming step.

17. A method as recited in claim 11, wherein said voltage applying step at said second developing station further comprises applying a voltage of opposite polarity to said second developing means.

18. A method as recited in claim 11, further comprising:

maintaining said transparent conducting layer at a reference potential; and applying said first voltage at said first developing station in said first polarity relative to said reference potential.

19. A method as recited in claim 11, wherein said step of applying said second voltage comprises maintaining said second developing means at said reference potential.

20. A method as recited in claim 19, wherein said step of applying said second voltage comprises applying a voltage of a level and polarity sense relative to said reference potential which is opposite that of said first voltage.

21. An apparatus for forming a toner image of an object, comprising:

a photosensitive medium comprising a laminate of a transparent conductive layer and a photoconductive layer, said photoconductive layer having a first surface laminated with said transparent conductive layer and a second surface defining the surface of said photosensitive medium on which a toner image is to be formed, said photoconductive layer defining trapping potential levels closely adjacent said second surface thereof;

a first developer means for forming a layer of charged toner particles of a first polarity on said second surface of said photoconductive layer and inducing corresponding charges of a second, opposite polarity in said transparent conducting layer;

means for selectively exposing said photoconductive layer in accordance with the toner image to be formed, said exposed portions of said photoconductive layer being rendered conductive and permitting said charges of the second polarity in the portions of said transparent conductive layer corresponding to the exposed, conductive portions of said photoconductive layer to traverse therethrough and be trapped at positions closely adjacent said second surface of said photoconductive layer established by said trapping potential levels, said exposed portions of said photoconductive layer, upon cessation of exposure by the light beam, reverting to a nonconductive state and fixing the negative charges in the trapped positions within said photoconductive layer, said fixed charges defining an electrostatic latent image of the object; and second developer means for applying a voltage of a second opposite, polarity to said charged toner particles for removing said charged toner particles from said second surface of said photoconductive layer in those portions not exposed by the light beam, the toner particles corresponding to the electrostatic latent image remaining adhered thereto and comprising the toner image of the object.

22. An apparatus as recited in claim 21, wherein:

said first and second developer means are displaced relatively to each other and disposed closely adjacent said second surface of said photoconductive layer of said photosensitive medium; and said selective exposing means is disposed on the opposite surface of said photosensitive medium.

23. An apparatus as recited in claim 22, wherein said selective exposing means is disposed on the opposite surface of said photosensitive medium in alignment with said first developer means.

24. An apparatus as recited in claim 21, wherein said toner particles comprise nonconductive material, and wherein said first developor means charges said nonconductive toner particles with charges of said first polarity by subjecting said toner particles to mutual friction.

25. An apparatus as recited in claim 21, wherein said toner particles comprise conductive material and wherein said first developer means charges said conductive toner particles with charges of said first polarity by subjecting said conductive toner particles to a voltage of said first polarity.

26. An apparatus as recited in claim 21, wherein there is further provided means for transporting said photosensitive medium in sequence past said first developer means and said second developer means.

27. An apparatus as recited in claim 21, wherein there is further provided:

means for connecting said transparent conducting layer to a reference potential; and means for applying a first voltage of the first polarity, relative to the reference potential, to said first developer means.

28. An apparatus as recited in claim 27, wherein there is further provided means for applying a second voltage of said opposite polarity to said second developer means.

29. An apparatus as recited in claim 27, wherein there is further provided means for connecting said second developer means to said reference potential.

* * * * *

UNITED STATES PATENT AND TRADEMARK OFFICE

CERTIFICATE OF CORRECTION

PATENT NO. : 4,666,801

DATED : May 19, 1987

INVENTOR(S) : Kimura et al.

It is certified that error appears in the above-identified patent and that said Letters Patent is hereby corrected as shown below:

FRONT PAGE:
[73] "Kanagawa" should be --Kawasaki-S HI--.

[57] Abstract, second column, line 20, "laten" should be --latent--.

Col. 14, equation (7), "ε" should be -- δ --.

Col. ]5, line 39, "in" should be --is--. (first occurrence)

Signed and Sealed this

Twenty-third Day of August, 1988

*Attest:*

DONALD J. QUIGG

*Attesting Officer*

*Commissioner of Patents and Trademarks*